US009767677B1

(12) United States Patent
Paulin

(10) Patent No.: US 9,767,677 B1
(45) Date of Patent: Sep. 19, 2017

(54) DATA DRIVEN EMERGENCY NOTIFICATION APPLICATION AND SYSTEM

(71) Applicant: Prescott N Paulin, Forsyth, IL (US)

(72) Inventor: Prescott N Paulin, Forsyth, IL (US)

( * ) Notice: Subject to any disclaimer, the term of this patent is extended or adjusted under 35 U.S.C. 154(b) by 33 days.

(21) Appl. No.: 14/164,243

(22) Filed: Jan. 26, 2014

(51) Int. Cl.
*G08B 27/00* (2006.01)
*G08B 25/01* (2006.01)

(52) U.S. Cl.
CPC ..... *G08B 27/001* (2013.01); *G08B 25/016* (2013.01)

(58) Field of Classification Search
CPC ..... A61B 5/681; A61B 5/1117; A61B 5/0006; A61B 5/0022; A61B 8/565; G06F 19/3418; G06F 19/345; G06F 19/3462; G06F 19/3487; G08B 21/02
See application file for complete search history.

(56) References Cited

U.S. PATENT DOCUMENTS 8,538,374 B1 9/2013 Haimo et al.
2003/0012344 A1* 1/2003 Agarwal ..... H04M 11/04 379/37
2010/0231714 A1* 9/2010 Flores ..... G08B 13/19613 348/143
2011/0117878 A1* 5/2011 Barash ..... G08B 21/0211 455/404.2

OTHER PUBLICATIONS

18 USC 922.*

* cited by examiner

*Primary Examiner* — James Yang
(74) *Attorney, Agent, or Firm* — Law Office of Jerry Joseph, PLC; Jerry K. Joseph

(57) ABSTRACT

An emergency notification method which includes receiving an alert signal triggered by a user from a first remote device during an emergency situation, receiving user identification data of the user from the first remote device, sending a response request signal to a plurality of first responders with a second remote device, receiving location information from the user and the plurality of first responders from the first and second remote device, respectively, and sending the alert signal to authorized first responders of the plurality of first responders to respond to the emergency situation.

16 Claims, 14 Drawing Sheets

DATA DRIVEN EMERGENCY NOTIFICATION APPLICATION AND SYSTEM

BACKGROUND

1. Field of the Invention

The present general inventive concept relates generally to an emergency notification application and system, and more particularly to a data driven emergency notification application for mobile devices and a system used to implement the application.

2. Description of the invention

Over the past several years, violent crimes have been on the rise in the United States, and around the world. On average, the time for a violent criminal activity to occur is around ninety seconds. However, the average response time for police and emergency personnel ranges anywhere from ten minutes to an hour, depending on the location.

Typically, victims experiencing an emergency situation dial 911 from a telephone or a mobile device. However, for the 911 service to be effective, the victim must be able to communicate with a dispatcher for a substantial amount of time, which often is not possible. The victim must communicate to the dispatcher vital situation information, which is not possible in many situations.

However, due to the inefficiencies with currently available systems, many citizens in all locations have taken control and have sought out first-aid and self-defense training and have even obtained weapons for protection. These citizen defenders are often ready and willing to provide help to those in need, but are not aware when and where the emergent situations are occurring.

Therefore what is needed is simple application, which notifies police, emergency personnel, and citizen defenders when a person needs assistance.

BRIEF SUMMARY OF THE GENERAL INVENTIVE CONCEPT

The present general inventive concept allows for a plurality of users to utilize the mobile application which implements a method according to the present invention. The plurality of users includes a first group of law-abiding citizens who have not been trained or licensed to carry firearms and who are in need of emergency assistance, and a second group of legal firearms owners who have been licensed to carry firearms and are willing to assist diffuse potentially life-threatening situations. The second group includes weapons-trained concerned citizens, law enforcement officers, firefighters, and medically trained first responders ready and willing to assist the first group during emergency situations.

Once the alert signal is triggered, the system according to the present general inventive concept transmits a notification including a user's location, profile identifier, captured video and audio, as well as an active audio stream (VOIP) into the platform via a network and an internet connection. The platform stores, analyzes, and transmits the notification, which includes all available data, to authorized first responders within a certain proximity to the user and who are available to assist the user. The present general inventive concept includes a server-based distributed emergency response platform ("DERP") residing on scalable cloud computing infrastructure which stores, analyzes, and transmits initial and ongoing situation information captured as part of the emergency situation. The DERP locates other nodes (i.e., first responders) who passively participate within the network and update their location information at regular intervals while traveling between different regions, who are capable of responding to the initial alert in an area of operations radiated in proximity to the alerting node, and alerts them to a request for assistance, which they may choose to accept or deny. Upon accepting the request, audio and/or video channel of a first node is opened for review by other responding nodes, as well as an active GPS transmission. The location information from each first responder may be transmitted to other first responders, in real-time, to help coordinate emergency assistance. That is, all first responders may receive information on all other first responders responding to a particular alert signal.

These responding nodes also transmit their own notifications including their user's location, profile identifier, captures video and audio, as well as active audio stream (VOIP) into the platform via a network and an internet connection.

Features and/or utilities of the present general inventive concept may be achieved by providing an emergency notification method which includes receiving an alert signal triggered by a user from a first remote device during an emergency situation, receiving user identification data of the user from the first remote device, sending a response request signal to a plurality of first responders with a second remote device, receiving location information from the user and the plurality of first responders from the first and second remote device, respectively and sending the alert signal to authorized first responders of the plurality of first responders to respond to the emergency situation.

The emergency notification may further include receiving feedback information from the user regarding the first responder responding to the emergency situation.

The authorized first responders may include first responders located within a predetermined distance from the user.

The authorized first responders may include first responders receiving positive feedback information from the user.

The emergency notification method may further include displaying the location information of the user and the first responder on the second remote device.

The emergency notification method may further include displaying restricted areas on the second remote device.

The emergency notification method may further include displaying directions from the location of the first responder to the location of the user, while avoiding the displayed restricted areas, on the second remote device.

The emergency notification method may further include receiving real-time audio, video, and location information from the first remote device.

The emergency notification method may further include sending the received real-time audio, video, and location information from the first remote device to the second remote device.

BRIEF DESCRIPTION OF THE DRAWINGS

These and other features, aspects and utilities of the present general inventive concept will become better understood with reference to the following description, appended claims and accompanying drawings where:

DETAILED DESCRIPTION OF THE PREFERRED EMBODIMENTS

Figure 1:
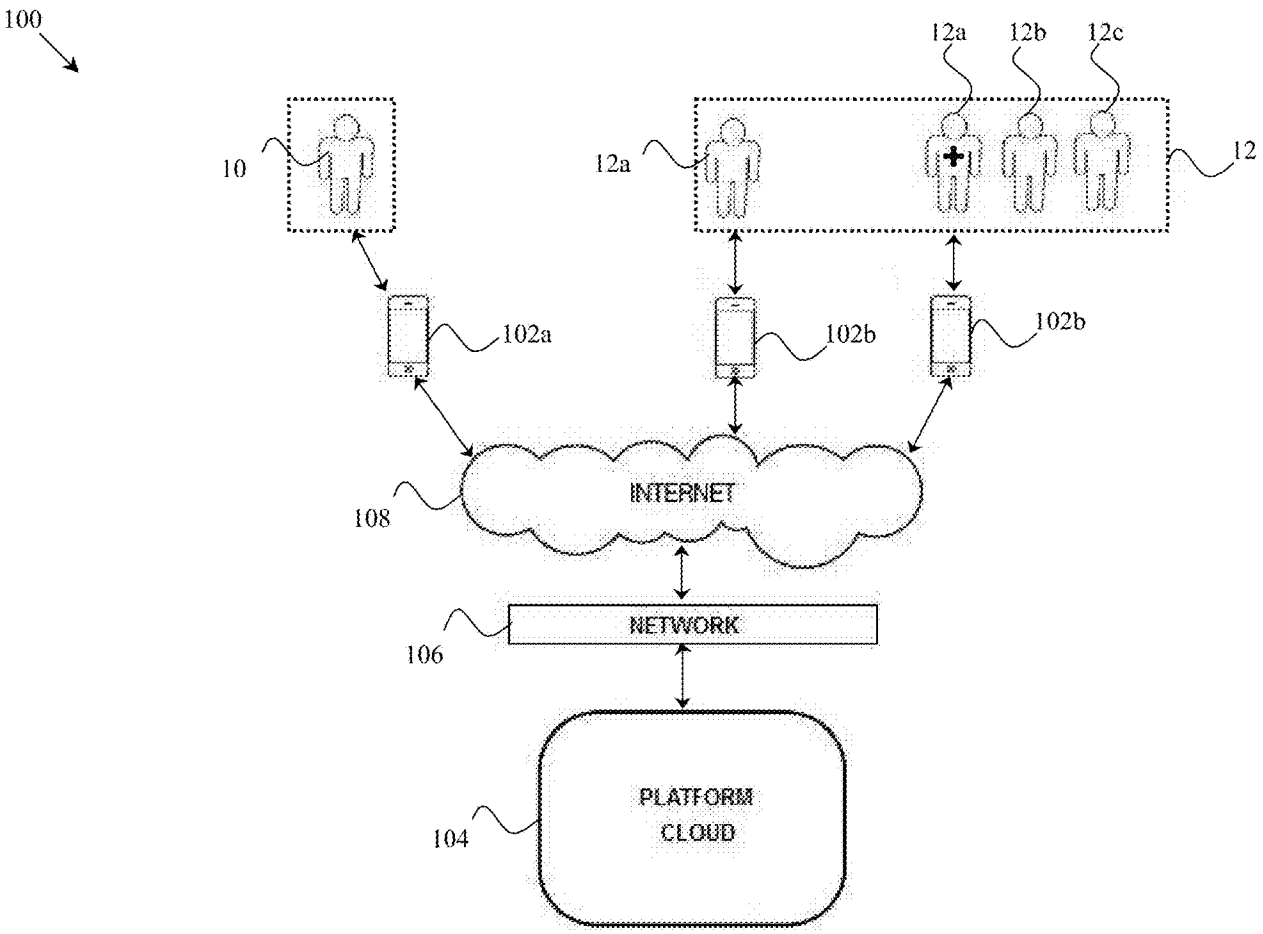
FIG. 1 is a schematic diagram illustrating a system implementing the data driven emergency notification application according to an exemplary embodiment of the present general inventive concept.

As will be appreciated by one skilled in the art, aspects of the present general inventive concept may be embodied as a system, method or computer program product. Accordingly, aspects of the present general inventive concept may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present general inventive concept may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wire-line, optical fiber cable, RF, etc., or any suitable combination of the foregoing. Computer program code for carrying out operations for aspects of the present general inventive concept may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present general inventive concept are described below with reference to flowchart illustrations and/or block diagrams of methods, apparatus (systems) and computer program products according to embodiments of the general inventive concept. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic diagram illustrating a system 100 used to implement a data driven emergency notification application according to an exemplary embodiment of the present general inventive concept.

Referring to FIG. 1, the system 100 includes a remote device 102*a* and 102*b* which may be coupled to a platform 104 via a network 106 through an internet connection 108. The network 106 may be coupled to the internet connection 108 through a wired or wireless connection. The remote device 102 is considered a computer that comprises a non-transitory computer readable storage medium having a computer usable program code implementing the present general inventive concept stored thereon. The remote device 102 may include mobile phones, personal computers, and the like.

The platform 104 may communicate with remote devices 102 through the network 106 and the internet connection 108. The platform 104 receives an input (i.e., alert signal) from a user 10 using a first-remote device 102*a* requesting assistance, and transmits the alert signal to at least one first responder 12 using a second-remote device 102*b*, designated as an authorized first responder 12. Users 10 and the first responders 12 communicate with the platform 104 using the first and second remote devices 102*a* and 102*b*, respectively.

First responders 12 may include government agency first responders 12*a*, citizen first responders 12*b*, or user-defined first responders 12*c*. In exemplary embodiments, the user-defined first responders may include family first responders and friend first responders. The first responders 12 may use to platform 104 as users 10, if needed. That is, if the first responders 12 are in an emergency situation, the first responders 12 may also trigger an alert signal to request assistance from other first responders 12.

In exemplary embodiments, the system 100 may also be used in large combat situations wherein users 10 (i.e., soldiers) may activate alert signals and the platform 104 may be used to prioritize a response by first responders 12 (i.e., medics). The platform 104 would analyze location and severity of injuries in order to triage which medics 12 to send to which injured soldiers 10. The platform 104 would analyze equipment in possession of each first responders 12 in order to properly direct the necessary equipment to each emergency situation.

In the present exemplary embodiment, the authorized first responder 12 includes first responders 12 located within a predetermined distance from the user 10. In alternative exemplary embodiments, the authorized first responders 12 include first responders 12 having certain qualifications, certifications, training, security clearance, and/or experience level. For instance, the platform 104 may request assistance only from first responders 12 who have current certifications for cardiopulmonary resuscitation ("CPR"). However, the present general inventive concept is not limited thereto. The platform 104 may also be informed as to equipment in stock as well as in loadout in determining which first responder 12 is capable of responding to which alert signal, depending on the equipment, training, certifications, and nature of the user's 10 injury. In exemplary embodiments, the platform 104 may be used to re-supply or restock first responders 12 with necessary equipment and supplies. That is, the platform 104 may be used to track a usage of supplies carried by the first responders 12, and send supplies before the supplies completely run out. For example, the platform 104 may track the usage of bullets from each first responder 12 and notify the first responder 12 before he completely runs out of bullets.

In exemplary embodiments, the predetermined distance may be equal to or less than about 10 miles, and more preferably equal to or less than about 5 miles. However, the present general inventive concept is not limited thereto. That is, the predetermined distance may vary according to a mode of transportation used by the first responder 12. For instance, first responders 12 traveling by car, segway, or other motorized vehicles may have a larger response area (i.e., predetermined distance) than first responders 12 traveling by foot.

Figure 2:
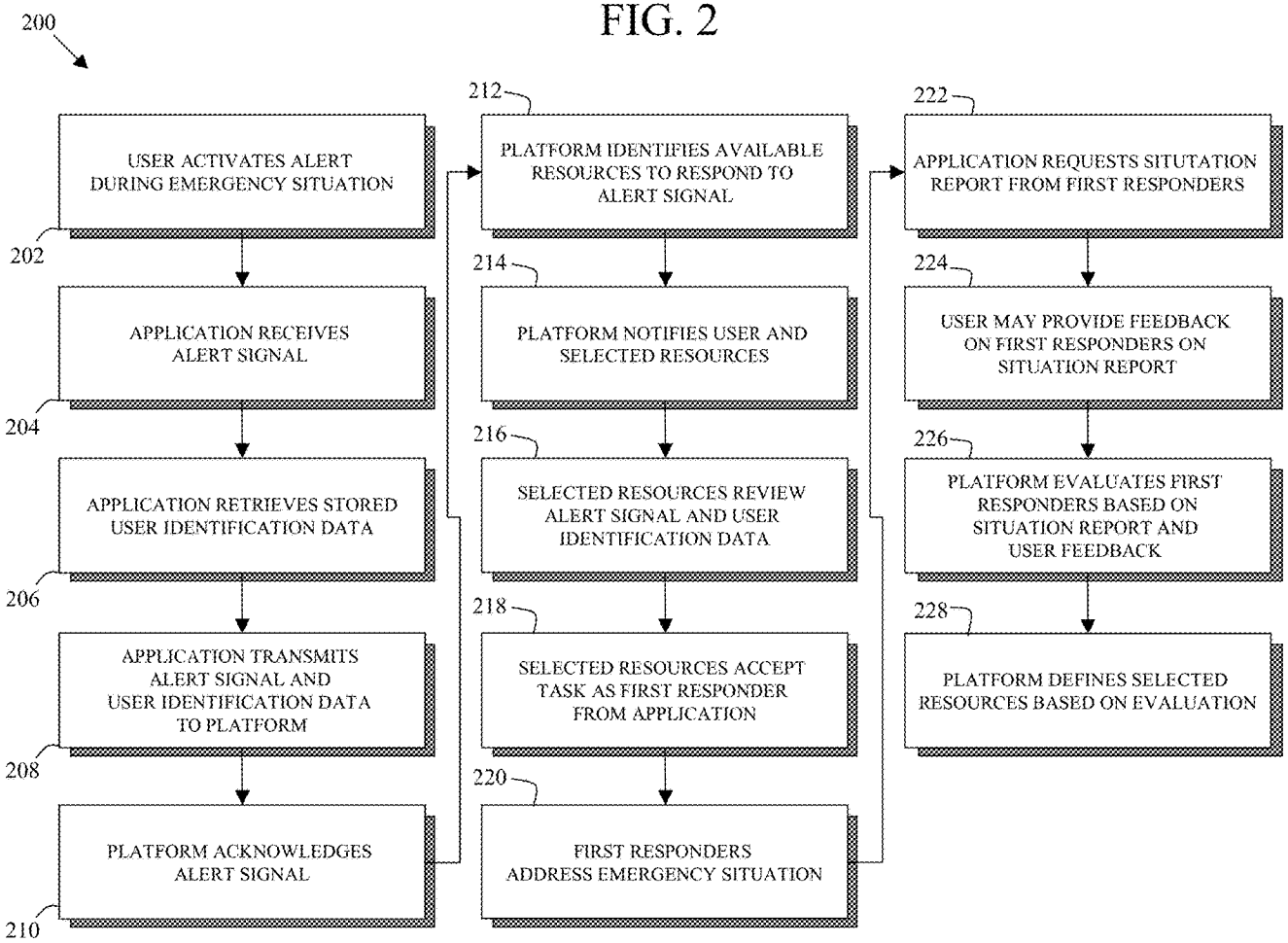
FIG. 2 is a flowchart illustrating an implementation of a data driven emergency notification program code according to an exemplary embodiment of the present general inventive concept.

FIG. 2 is a flowchart illustrating an implementation 200 of a data driven emergency notification program code (i.e., mobile application) according to an exemplary embodiment of the present general inventive concept.

Referring to FIG. 2, the implementation 200 includes a user 10 activating an alert signal on a mobile device 102*a* during an emergency situation in operation 202. The user 10 includes a person facing any type of emergency situation requiring assistance from a first responder 12.

The user 10 may use the remote device 102*a* during the emergency situation to trigger and send an alert signal to the platform 104 via the mobile application 200 in operation 204. The user 10 may define a manner in which the alert signal is activated. For instance, the user 10 may configure the mobile application 200 to activate the alert signal when the user 10 holds down a volume button on the remote device 10 for a predetermined amount of time. However, the present general inventive concept is not limited thereto. In alternative exemplary embodiments, the alert signal may be received by the mobile application 200 by the triggering of an accelerometer threshold or by speaking a command into a microphone of the remote device 102.

In operation 206, once the alert signal has been triggered, the mobile application 200 may retrieve user identification data stored on the first remote device 102*a* or stored within the platform 104 cloud. The user identification data may include the user's 10 name, home address, health condition, allergies, or emergency contact information stored on the mobile device 102*a*. In alternative exemplary embodiments, audio, video, and/or still image capture features of the remote device 102*a* may be activated in order to record emergency situation data, which may also be retrieved by the mobile application 200. For instance, a microphone and/or a video camera of the remote device 102*a* may be activated in order to record audio and/or video surrounding the emergency situation. The mobile application 200 retrieves data 202 including the user identification data, the recorded emergency situation data, and location data, if available, when the alert signal has been triggered. The location data may include location information obtained by a GPS feature on the remote device 102*a* when the user 10 triggered the alert signal. In exemplary embodiments, the location data may further include real-time positioning data retrieved using the GPS feature, cellular signal triangulation and/or conventionally known WIFI positioning techniques. The platform 104 may further receive audio and/or video signals from an external device in communication with the remote device 102*a*.

In operation 208, the mobile application 200 transmits the data 202 to the platform 104. In alternative exemplary embodiments, the platform 104 may receive a real-time audio and/or video feed from the user's 10 mobile device 102*a*. The platform 104 may then acknowledge receipt of the data 202 by sending a signal-received signal to the first remote device 102*a* in operation 210.

In operation 212, the platform 104 may then identify all available resources (i.e., first responders) ready to respond to the alert signal. Each first responder 12 may communicate with the platform 104 via a dedicated remote device 102*b*. Similarly, the platform 104 may communicate with each first responder 12 via the mobile application 200 stored and executed on the remote device 102*b*.

The platform 104 may retrieve location data from the second remote device 102*b* to determine a proximity of the first responders 12 relative to the user 10. First responders 12 within a predetermined distance from the user 10 will be defined as selected first responders 12. For example, first responders 12 within a predetermined distance of about 5 miles to about 10 miles away from the user 10 may be categorized as selected first responders 12. The platform 104 may exclude first responders 12 from being categorized as selected first responders 12, based on evaluation data from previous emergency situations or as being outside of the predetermined distance.

In operation 214, the platform 104 notifies the user 10 and the selected first responders that the alert signal was received. The platform 104 sends a response request signal to the selected first responders via the mobile application 200 on the remote device 102*b*. In addition, the platform 104 sends the user identification data, the alert signal, the location data, and the recorded emergency situation data, if available, to the selected first responders 12.

In operation 216, the selected first responders 12 may review the alert signal, the user identification data, the location information, and the recorded emergency situation data in order to determine whether to accept or deny the user's 10 request for assistance.

In operation 218, a first responder 12 within the group of selected first responders 12 accepts the request for assistance by using the remote device 102*b*. The first responder 12 may respond by selecting a "will respond" button within the application 200 on the remote device 102*b*. The platform 104 may then categorize these first responder's 12 (i.e. first responders accepting requests) as actual first responders.

In operation 220, the actual first responders would then assist the user 10 in addressing the emergency situation. The platform 104 may further provide real-time GPS location information from the user's 10 mobile device 102*a* to the mobile device 102*b* of the actual first responders in order to assist in locating the user 10. The platform 104 transmits the location information of the user 10 when the alert signal was activated and a real-time GPS location from the user's 10 mobile device 102*a*, if available.

In addition, the platform 104 may retrieve real-time audio and/or video from the first remote device 102*a* and transmit this data to all actual first responders 12 via the platform 104 and the second remote devices 102*b*.

When the actual first responders completely address the user's 10 emergency situation, the platform 104 requests a situation report from the actual first responders responding to the alert signal in operation 222. The situation report may include details on the emergency situation, status of the user 10, response time, and the like.

In operation 224, users 10 who have initiated the alert signal may provide feedback on the actual first responders. That is, the user 10 may review the situation report provided by the actual first responders, and provide comments and/or suggestions on the accuracy of the situation report through the application on the mobile device 102*a*. The user 10 may further rate the actual first responders 12.

In operation 226, the platform 104 evaluates the actual first responders on effectiveness based on response time, the situation report, and the feedback provided by the user 10 in selecting first responders in future alert signal situations. First responders 12 receiving negative feedback may be ranked lower that other first responders 12.

In operation 228, the platform 104 selects potential resources (i.e., first responders) based on the evaluation and feedback provided by the user 10.

Figure 3:
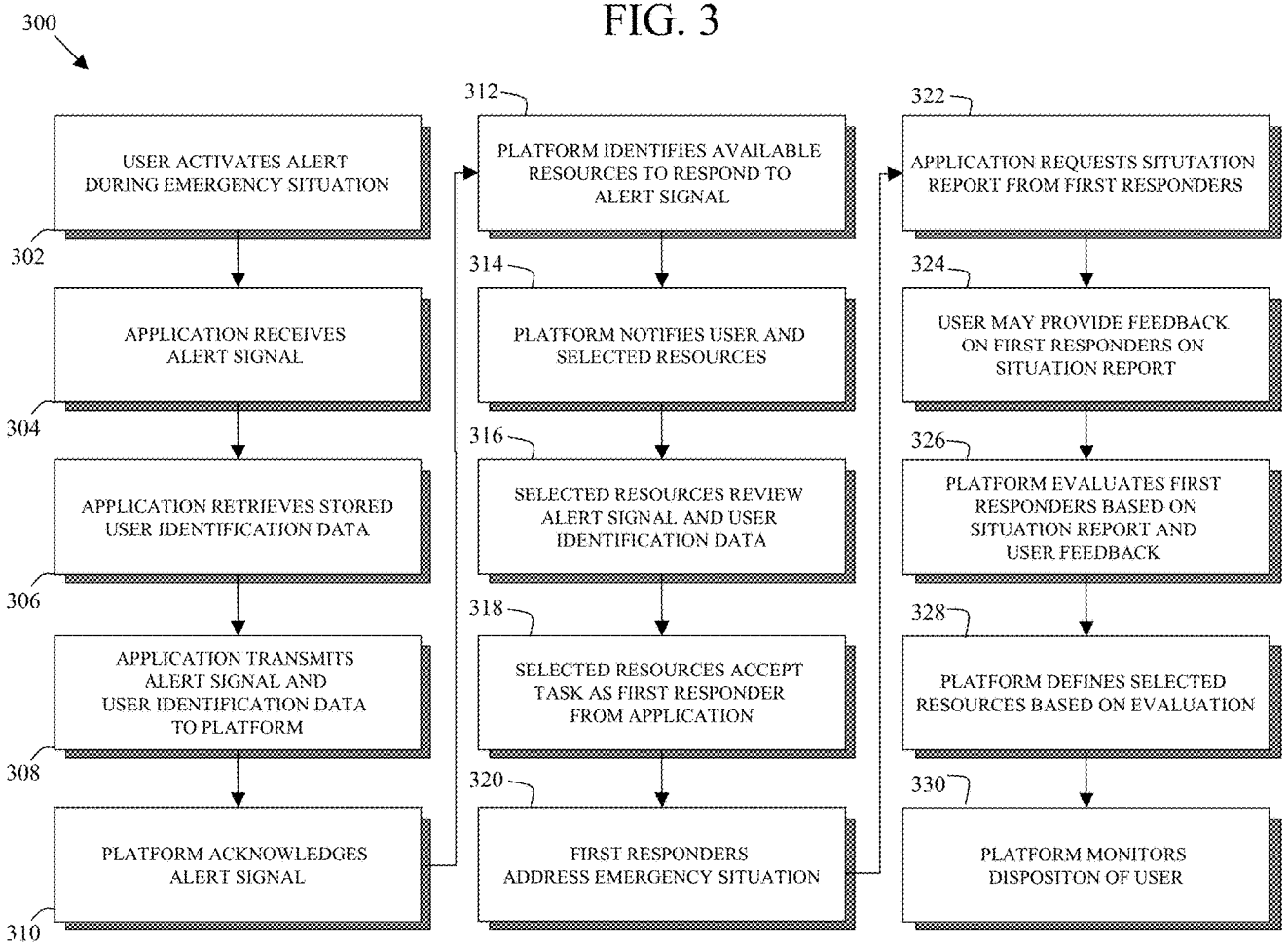
FIG. 3 is a flowchart illustrating an implementation of a data driven emergency notification application according to another exemplary embodiment of the present general inventive concept.

FIG. 3 is a flowchart illustrating an implementation of a data driven emergency notification application 300 according to another exemplary embodiment of the present general inventive concept.

Referring to FIG. 3, the implementation of a data driven emergency notification application 300 according to the present exemplary embodiment utilizes the same system 100 and procedures as described above. That is, operations 302 through 328 are substantially similar to operations 202 through 228 of the previous embodiment. The data driven emergency notification application 300 further includes operation 330.

In operation 330, the platform 104 monitors a disposition of each user 10 activating the alert signal. This includes collecting disposition information from law enforcement and/or medical agencies to determine whether the user 10 (i.e., a victim) received justice and/or proper treatment after the emergency situation. The present embodiment further includes providing an analysis on this disposition information and reporting the analysis to a third party or another user. However, the present general inventive concept is not limited thereto.

Figure 4:
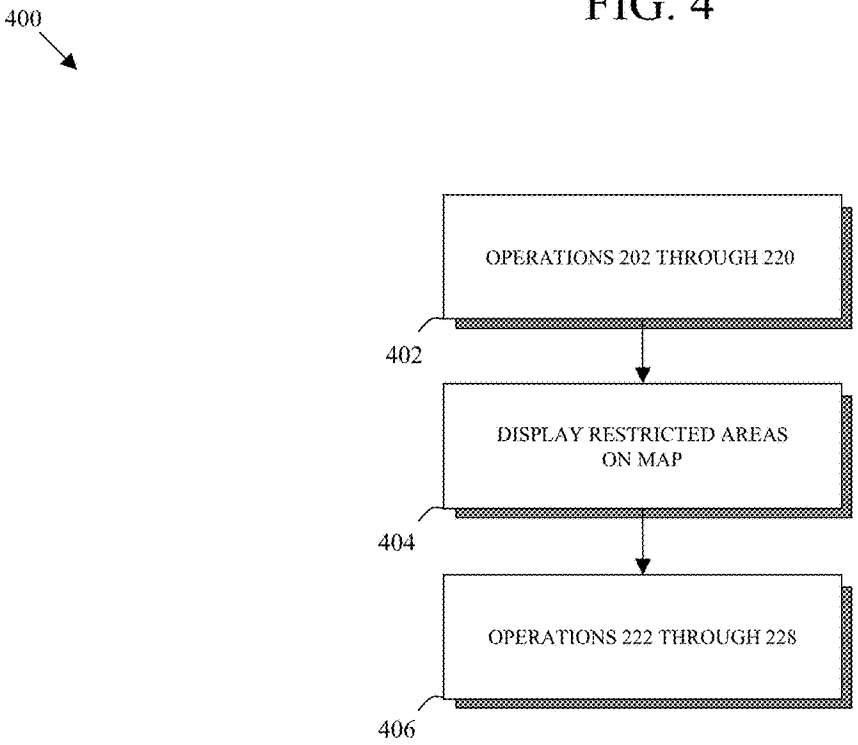
FIG. 4 is a flowchart illustrating an implementation of a data driven emergency notification application according to another exemplary embodiment of the present general inventive concept.
Figure 5:
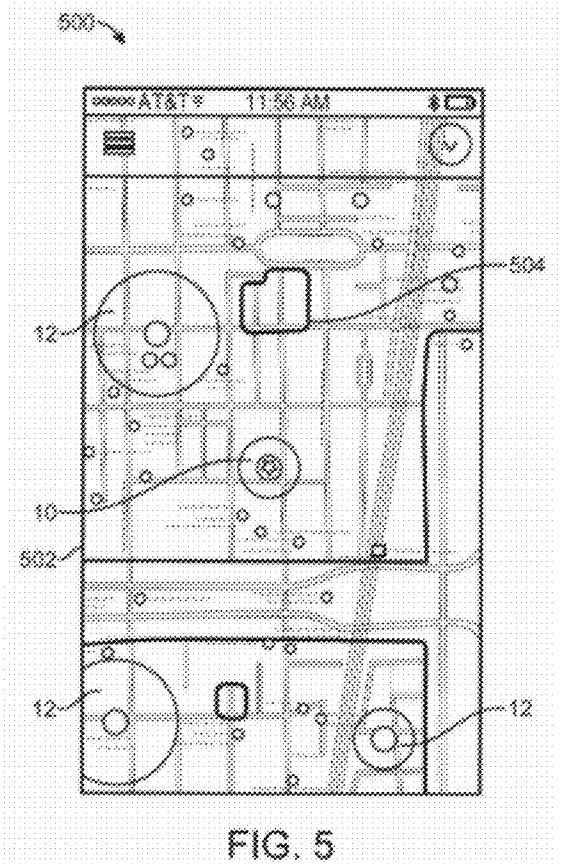
FIG. 5 illustrates a GUI showing geographic restricted areas on a map according to an exemplary embodiment of the present general inventive concept.
Figure 6:
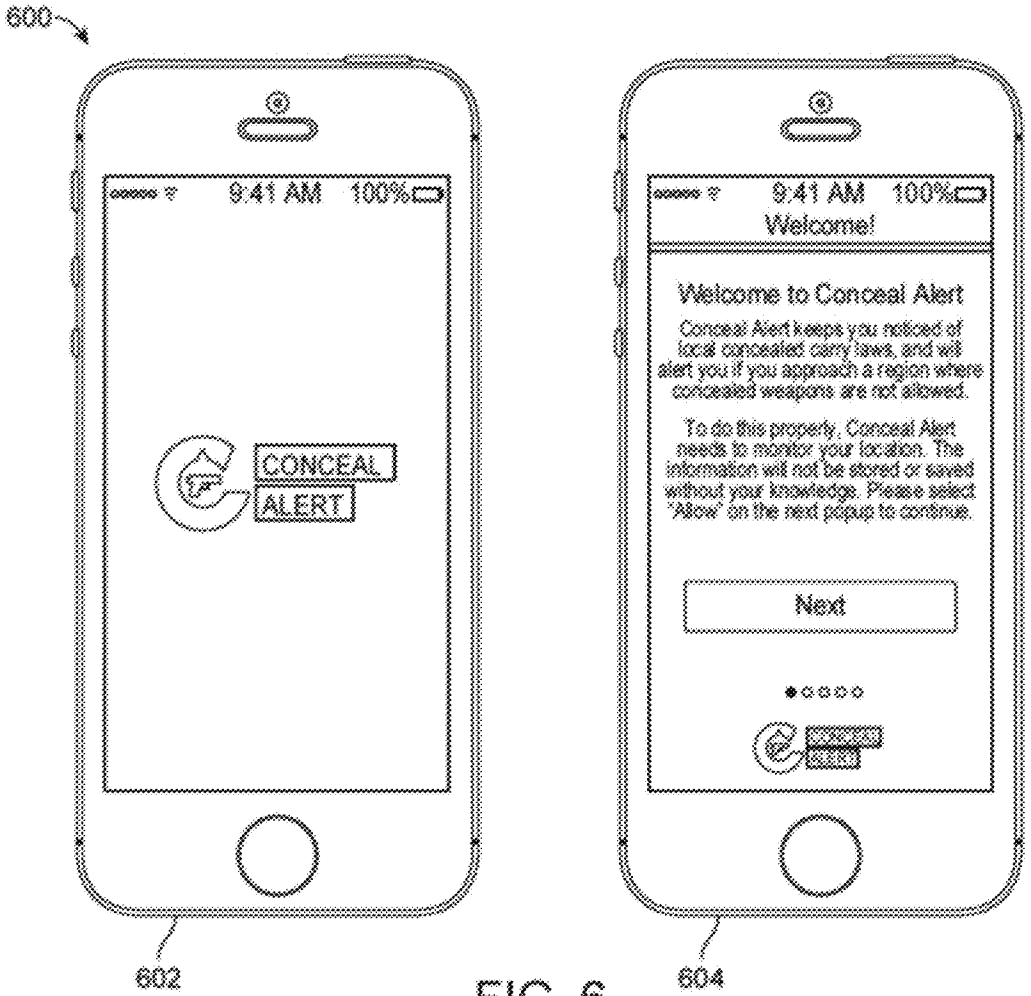
FIG. 6-12 illustrates GUI screenshots of the data driven emergency notification application according to an exemplary embodiment of the present general inventive concept.
Figure 7:
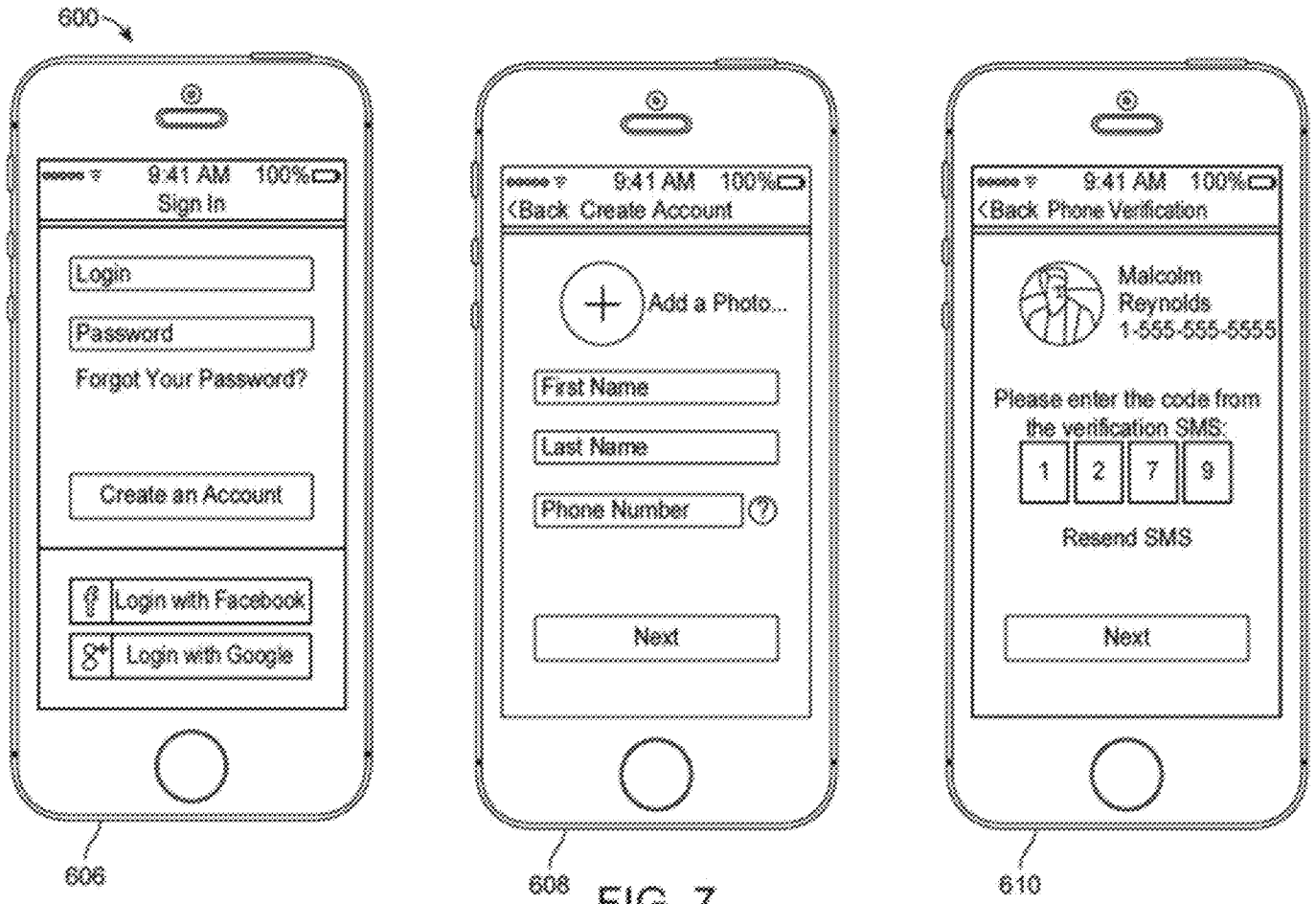
Figure 8:
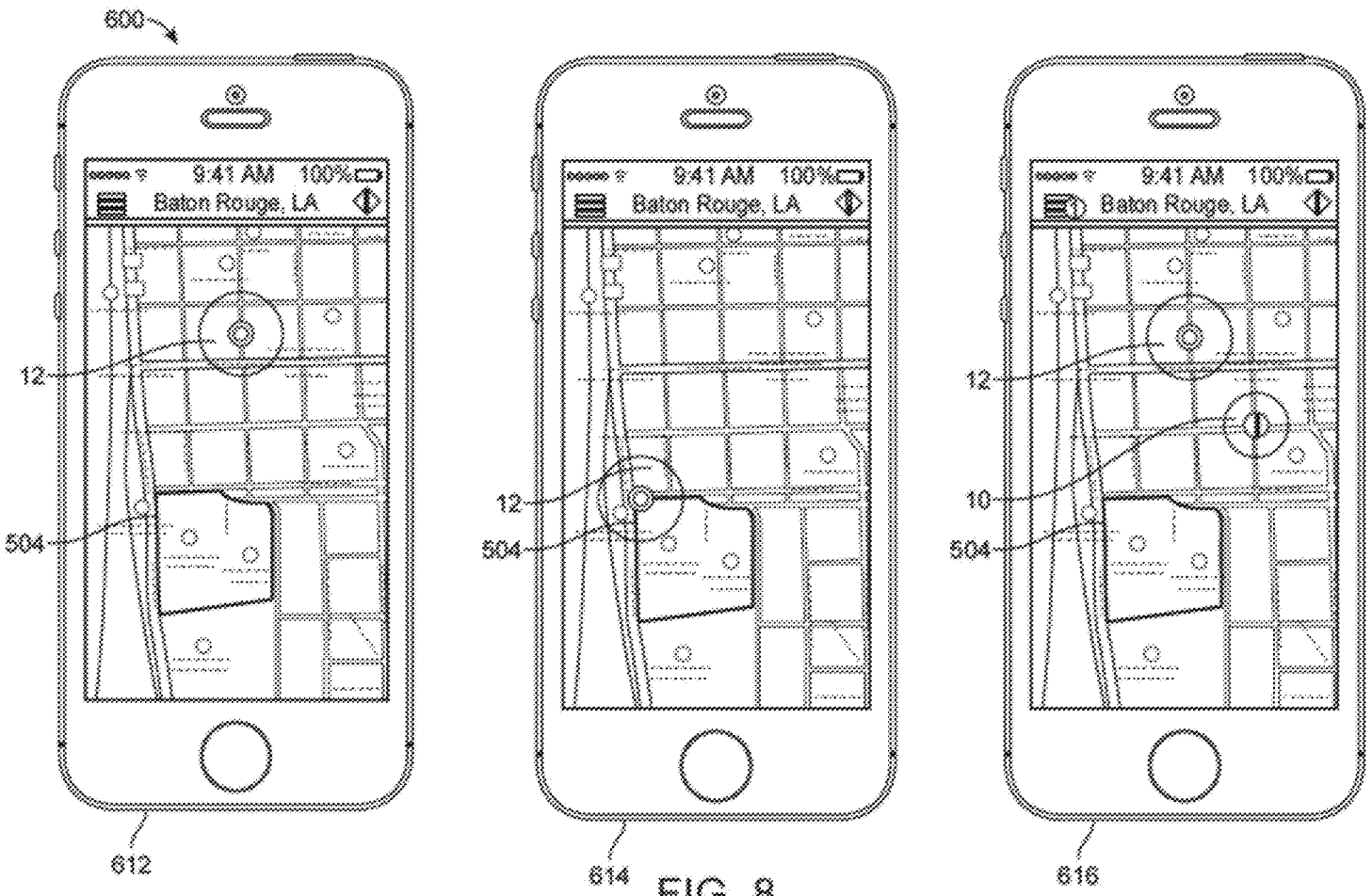
Figure 9:
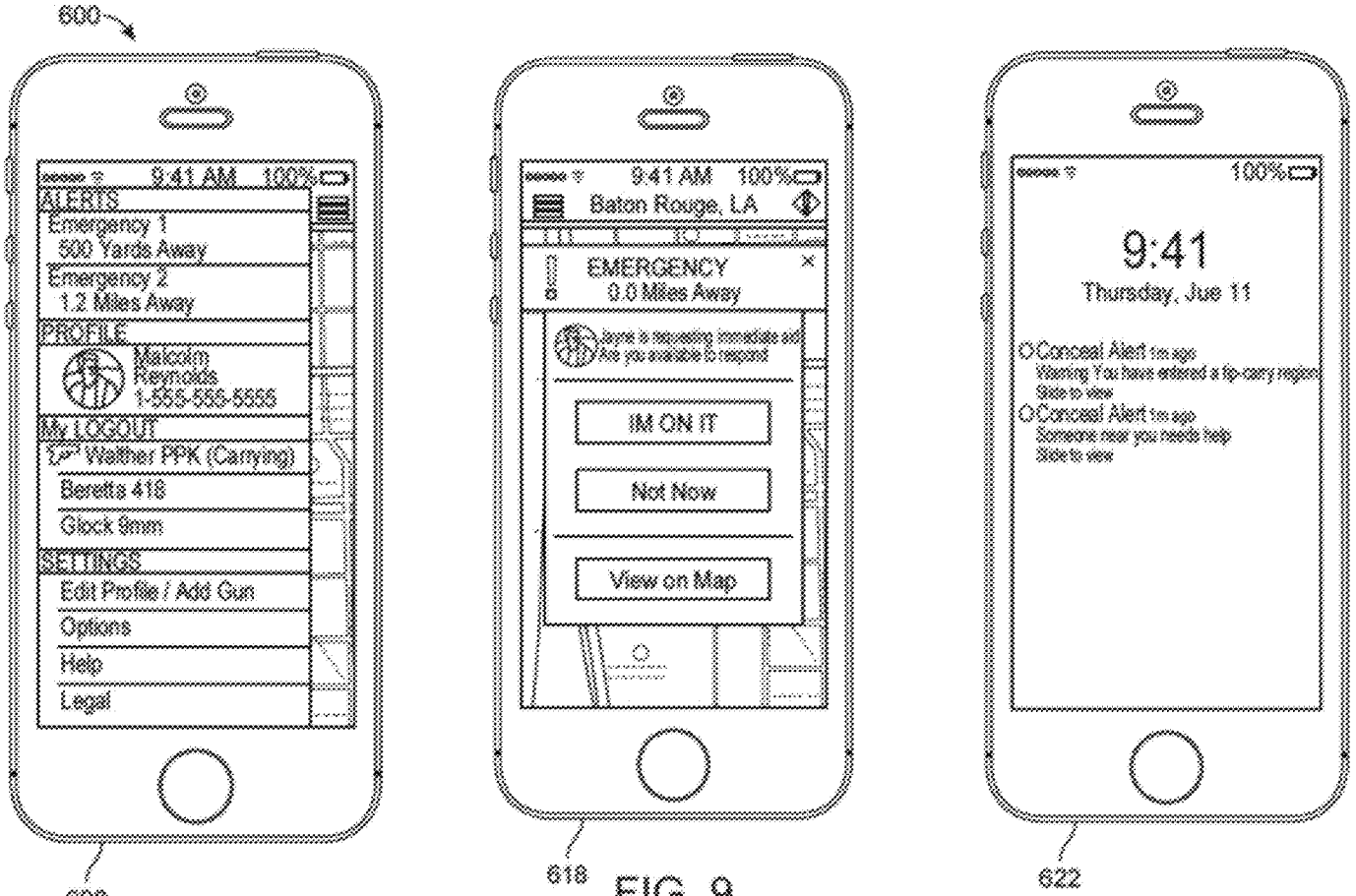
Figure 10:
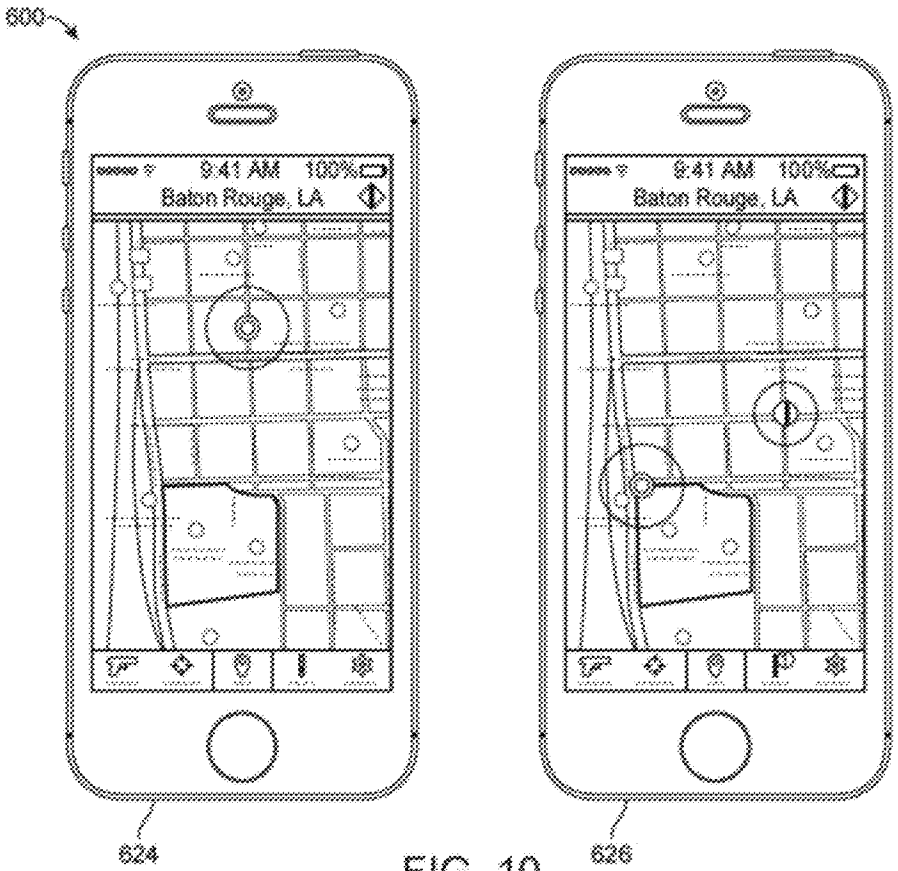
Figure 11:
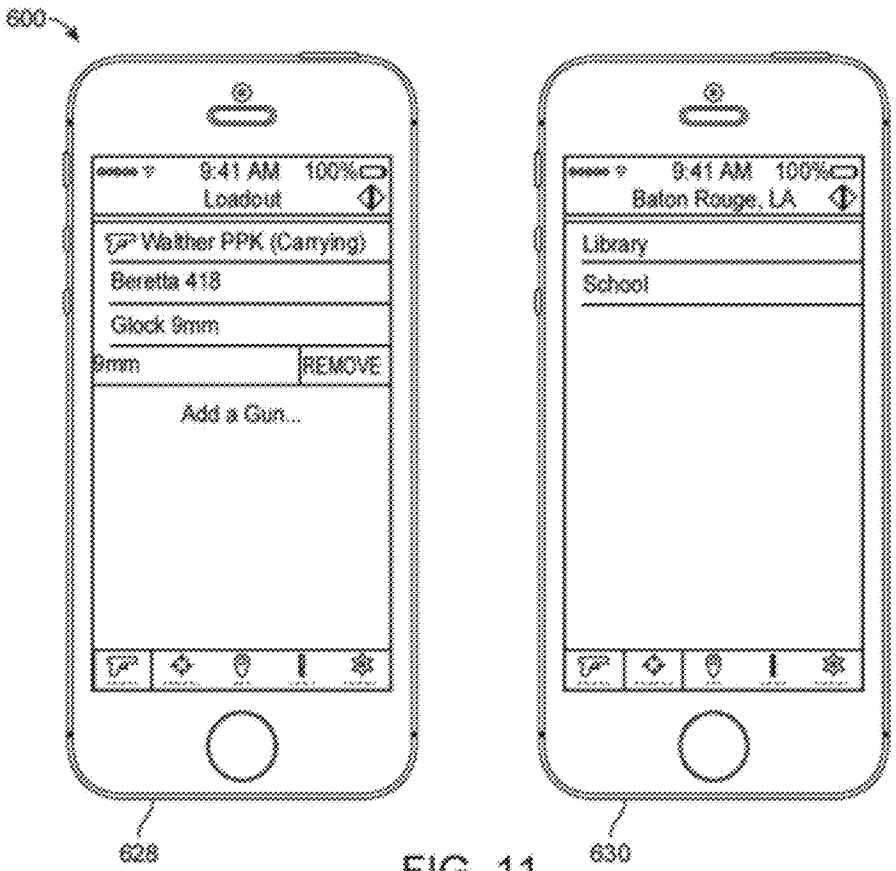
Figure 12:
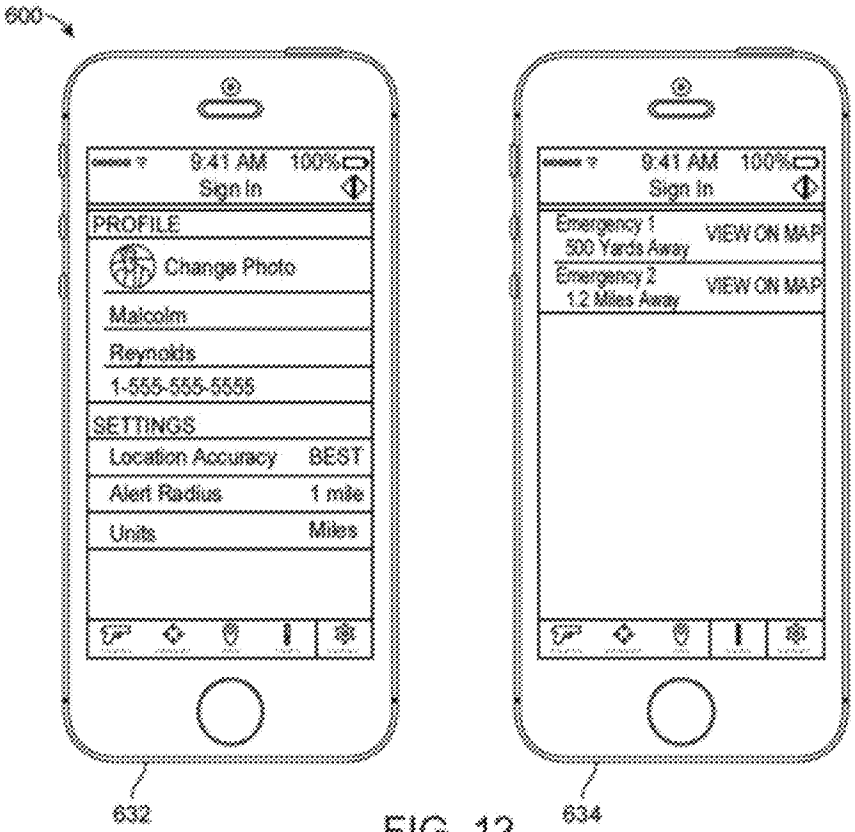

FIG. 4 is a flowchart illustrating an implementation of a data driven emergency notification application 400 according to another exemplary embodiment of the present general inventive concept. FIG. 5 illustrates a GUI 500 showing geographic restricted areas on a map according to an exemplary embodiment of the present general inventive concept.

Referring to FIG. 4, the implementation of a data driven emergency notification application 400 according to the present exemplary embodiment utilizes a similar system 100 and procedures as described above. That is, operation 402 includes operations 202 through 220 as described above in reference to the embodiment illustrated in FIG. 2.

The present embodiment of the data driven emergency notification application 400 further includes displaying a map 502 illustrating restricted areas 504 to the first responders 12 in operation 404. In exemplary embodiments, the map illustrating restricted areas 504 to the first responders 12 may be displayed when desired. The map 502 illustrates the real-time locations of the user 10 and of the first responders 12. Operation 406 includes operations 222 through 228 as described above in reference to the embodiment illustrated in FIG. 2.

Referring to FIG. 5, the application displays a graphical user interface (GUI) 500 showing a map 502 of current locations of the user 10 and the first responders 12, including streets, buildings, and restricted areas 504. The restricted areas 504 may include areas in which carrying a concealed weapon is not permitted. For instance, the GUI 500 may illustrate a geo-fence around areas defined within a legal statute where concealed carrying a weapon is not permitted. The mobile application may further sound an audio and/or visual alarm to notify the first responders 12*b* of an approaching restricted area 504.

In alternative exemplary embodiments, once the selected first responders 12 accept the request for assistance, the mobile application may determine a best route to the user 10 and may provide a visual path guiding the first responders 12 to the user 10. In addition, the mobile application may further communicate with an external traffic system via the internet connection 108 and an external restricted area database to determine the best route to the user 10, avoiding all restricted areas 504 and/or traffic issues.

FIG. 6-12 illustrates GUI screenshots 600 of the data driven emergency notification application according to an exemplary embodiment of the present general inventive concept.

GUI screen shots 602 and 604 provides a company logo and brief description of the mobile application and may request a users permission to use the mobile device's location tracking features.

GUI screen shot 606 allows a user 10 or first responder 12 to login into the platform 104. Only authorized users would be provided access to the platform 104. In exemplary embodiments, law enforcement first responders 12 may be provided with a different level of access than other first responders 12.

GUI screen shot 608 may be used to record the users 10 or first responders 12 user identification information including name, phone number, profession, photo, and specialized training. The platform 104 may send the users 10 and first responders 12 a confirmation code which must then be entered on GUI screen shot 610 from the phone number provided by the user 10 and first responders 12.

GUI screen shots 612 through 616 illustrate the location of a user 12 approaching and entering a restricted area 504. GUI screen shot 616 illustrates the location of the first responder 12 relative to the user 10 triggering the alert signal relative to the restricted area 504.

GUI screen shots 618 through 620 illustrate a notification provided to first responders 12 and an input screen where first responders may accept or deny responding to an alert signal.

GUI screen shot 622 provides real-time alerts warning first responders of received alert signals and approaching or entered restricted areas 504.

Figure 13:
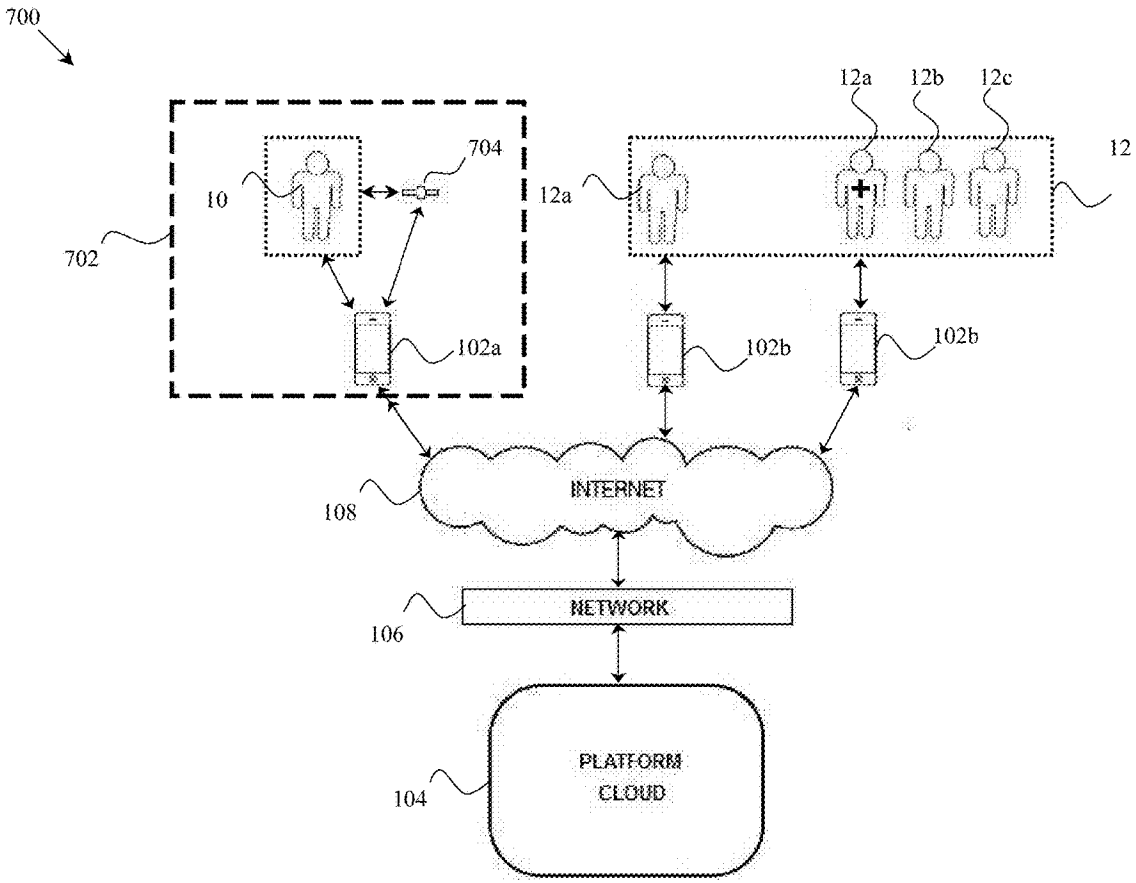
FIG. 13 is a schematic diagram illustrating a system implementing the data driven emergency notification application according to another exemplary embodiment of the present general inventive concept.
Figure 14:
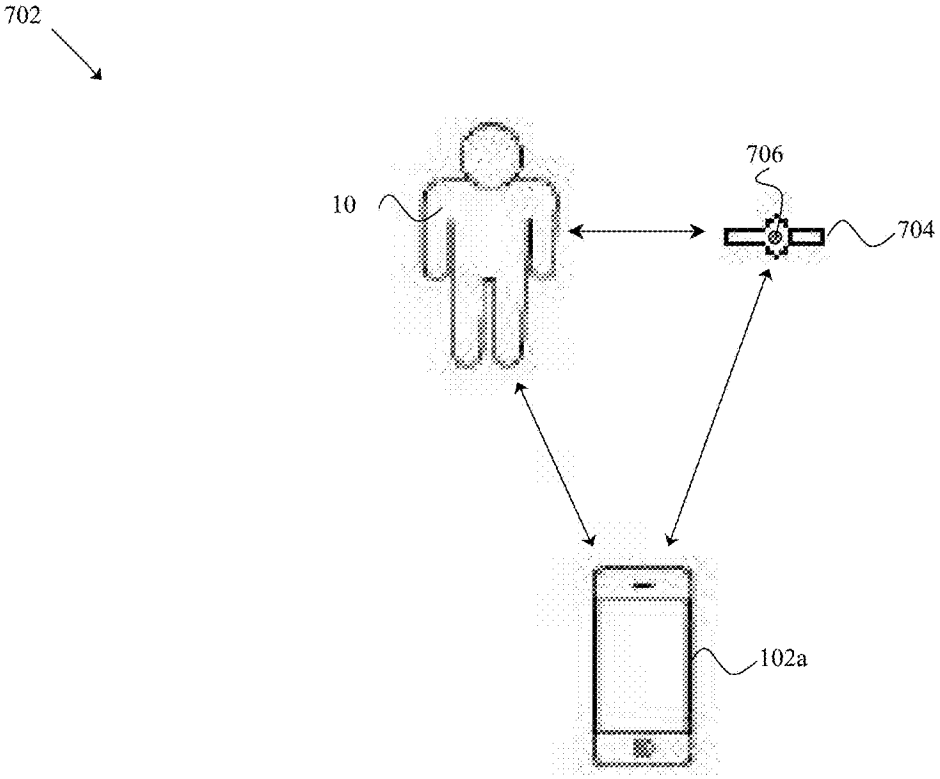
FIG. 14 is an exploded schematic diagram of the bluetooth wristband illustrated in FIG. 13.

FIG. 13 is a schematic diagram illustrating a system 700 implementing the data driven emergency notification application according to another exemplary embodiment of the present general inventive concept and FIG. 14 is an exploded schematic diagram of the blue-tooth wristband 702 illustrated in FIG. 3.

Referring to FIGS. 13 and 14, the system 700 includes substantially all of the features of the previous embodiment and further includes a wireless communication device 702. In exemplary embodiments, the communication device 702 may communicate with the remote device 102*a* using Bluetooth™ communication protocol or WIFI. However, the present general inventive concept is not limited thereto. In alternative exemplary embodiments, various other conventionally known protocols may be used to tether the remote device 102*a* with the communication device 702.

The communication device 702 may include a wristband, a watch, a ring, a piece of jewelry, and the like which may be worn by the user 10. The communication device 702 includes an alert button 702*a* which transmits an alert signal to the platform 104 via the remote device 102*a*, when pressed.

The communication device 702 allows a user 10 to trigger an alert signal when unable to access his/her remote device 102*a*. By pressing the alert button 702*a*, the communication device 702 transmits the alert signal to the platform 104 via the remote device 102*a*. The communication device 702 may further receive and store location information from the remote device 102 in predetermined intervals. Once the alert signal has been triggered, the communication device 702 may transmit the stored location information to the platform 104 via the remote device 102*a* or any other means for wireless communication, including an external WIFI connection.

In addition, law enforcement first responders are provided with a secure access to a portal to the platform in order to obtain reports on alerts, displays on the location, personal information and status of civilian first responders who are entering the area in response to the triggered alert signal. This law enforcement portal allows officers to send a message and order all other first responders to stand down and cease providing assistance.

In exemplary embodiments, the present general inventive concept further allows for gamification which rewards first responders with an elevated status, such as hero, for patrolling their local areas and responding to alert signals.

The present general inventive concept may further store training credentials and descriptions of tools used by nodes (i.e., participants or users) in the DERP network, and may further provide this information to other users and first responders. Any alert signal received by the network may be transmitted to the platform via a remote device, such as a mobile device, cellular phone, tablet, or personal computer, having a physical button used to trigger the alert signal.

In alternative exemplary embodiments, the emergency notification method may be used to report criminal activity, thereby turning the passive surveying nodded into an active alerting node seeking response from other participants or first responders in the network or in communication with the platform.

The present general inventive concept may further include a command center used to track and manage which agencies (e.g., law enforcement agencies and Interpol) and users are logged into the platform and attempting to manipulate data within the system. The command center may provide a listing of all users accessing the system and their corresponding geographical locations, in order to provide a thorough legal chain of custody regarding actions taken during or following an emergency situation.

The present general inventive concept further provides a portal which allows the command center to be in real-time communication with dispatchers, first responders, and users through VOIP or a chat box. The real-time communication may be digitally authenticated and transcribed by using an API for authorized providers, such as REV.COM. The portal may further be in real-time communication with social media of users within an area of operation or where the alert signal was triggered.

It is to be understood that the foregoing illustrative exemplary embodiments have been provided merely for the purpose of explanation and are in no way to be construed as limiting of the present general inventive concept. Words used herein are words of description and illustration, rather than words of limitation. In addition, the advantages and objectives described herein may not be realized by each and every exemplary embodiment practicing the present general inventive concept. Further, although the present general inventive concept has been described herein with reference to particular structure, steps and/or exemplary embodiments, the present general inventive concept is not intended to be limited to the particulars disclosed herein. Rather, the present general inventive concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the present general inventive concept.

What is claimed is:

1. An emergency notification method, the method comprising:

receiving an alert signal triggered by a user from a first remote device during an emergency situation;

receiving user identification data of the user from the first remote device;

sending a response request signal to a plurality of first responders with a second remote device;

receiving location information from the user and the plurality of first responders from the first and second remote device, respectively;

prioritizing a response by the plurality of first responders based on an analysis of location of the first responders and a severity of the emergency situation using a platform; and sending the alert signal to authorized first responders of the plurality of first responders from the platform to respond to the emergency situation, wherein the platform is programmed to automatically analyze a relative location of the first responders to the user, identify the emergency situation, identify equipment in possession of the first responders, and then to prioritize selection of the authorized first responders based on first responders who are closest to the user having the correct equipment for the identified emergency situation and then to automatically send the alert signal to the selected authorized first responders.

2. The emergency notification method of claim 1, further including receiving feedback information from the user regarding the first responder regarding the emergency situation.

3. The emergency notification method of claim 2, wherein the authorized first responders include first responders located within a predetermined distance from the user.

4. The emergency notification method of claim 2, wherein the authorized first responders include first responders receiving positive feedback information from the user.

5. The emergency notification method of claim 1, further including displaying the location information of the user and the first responder on the second remote device.

6. The emergency notification method of claim 5, further including displaying restricted areas on the second remote device.

7. The emergency notification method of claim 6, further including displaying directions from the location of the first responder to the location of the user, while avoiding the displayed restricted areas, on the second remote device.

8. The emergency notification method of claim 1, further including receiving real-time audio, video, and location information from the first remote device.

9. The emergency notification method of claim 8, further including sending the received real-time audio, video, and location information from the first remote device to the second remote device.

10. The emergency notification method of claim 6, wherein the restricted areas include areas in which carrying a concealed weapon is not permitted as defined in a legal statute.

11. A data driven emergency notification system, the system comprising:

a first remote device and a plurality of second remote devices each having a computer, the first remote device used by a user to submit an alert signal during an emergency situation and the plurality of second remote devices used by a plurality of first responders to be notified of the emergency situation;

a platform coupled to the first remote device and the plurality of second remote devices through an internet connection and a network, the platform configured to receive the alert signal and user identification data of the user from the first remote device and qualifications, experience level, and equipment in possession of the first responder from the plurality of second remote devices, wherein the platform is programmed to automatically analyze a relative location of the first responders to the user, identify the emergency situation, identify equipment in possession of the first responders, and then to prioritize selection of the first responders based on first responders closest to the user having the correct equipment for the identified emergency situation and then to automatically send the alert signal to the selected first responders.

12. The data driven emergency notification system of claim 11, wherein the platform is configured to receive real-time audio, video, and location information from the first remote device.

13. The data driven emergency notification system of claim 12, wherein the platform is configured to send the received real-time audio, video, and location information from the first remote device to the plurality of second remote devices.

14. The data driven emergency notification system of claim 13, wherein the platform is configured to obtain restricted area data to create a geo-fence in the location information displayed on the plurality of second remote devices.

15. The data driven emergency notification system of claim 14, wherein the restricted areas include areas in which carrying a concealed weapon is not permitted as defined in a legal statute.

16. An emergency notification method used in a combat situation, the method comprising:

receiving an alert signal triggered by a user from a first remote device during an emergency situation;

receiving user identification data of the user from the first remote device;

sending a response request signal to a plurality of first responders with a second remote device;

receiving location information from the user and the plurality of first responders from the first and second remote device, respectively;

prioritizing a response by the plurality of first responders based on an analysis of location and severity of injury to the user using a platform; and sending the alert signal to authorized first responders of the plurality of first responders from the platform to respond to the emergency situation, wherein the platform is programmed to automatically analyze a relative location of the first responders to the user, identify the emergency situation, identify equipment in possession of the first responders, and then to prioritize selection of the authorized first responders and to automatically send the alert signal to the selected authorized first responders based on the analysis of the location and severity of injury to the user.

* * * * *